United States Patent [19]

Aoyama

[11] Patent Number: 4,631,379

[45] Date of Patent: Dec. 23, 1986

[54] HIGH-FREQUENCY HEATING DEVICE HAVING ROTATABLE TRAY AND HIGH FREQUENCY WAVE AGITATOR

[75] Inventor: Shuki Aoyama, Aichi, Japan

[73] Assignee: Kabushiki Kaisha Toshiba, Kawasaki, Japan

[21] Appl. No.: 723,899

[22] Filed: Apr. 16, 1985

[30] Foreign Application Priority Data

| | | | |
|---|---|---|---|
| Apr. 20, 1984 | [JP] | Japan | 59-79383 |
| Apr. 20, 1984 | [JP] | Japan | 59-79384 |
| Sep. 7, 1984 | [JP] | Japan | 59-187574 |
| Sep. 7, 1984 | [JP] | Japan | 59-197578 |
| Sep. 7, 1984 | [JP] | Japan | 59-135950 |

[51] Int. Cl.[4] ..... H05B 6/78

[52] U.S. Cl. ..... 269/10.55 F; 219/10.55 E

[58] Field of Search ..... 219/10.55 F, 10.55 E, 219/10.55 R, 10.55 D

[56] References Cited

U.S. PATENT DOCUMENTS

| | | | |
|---|---|---|---|
| 4,092,512 | 5/1978 | Suzuki et al. | 219/10.55 F |
| 4,121,078 | 10/1978 | Takano et al. | 219/10.55 F |
| 4,258,630 | 3/1981 | Jorgensen et al. | 219/10.55 F |
| 4,501,945 | 2/1985 | Arabori et al. | 219/10.55 F |

FOREIGN PATENT DOCUMENTS

| | | | |
|---|---|---|---|
| 51-140849 | 5/1975 | Japan | 219/10.55 F |
| 52-29657 | 3/1977 | Japan | 219/10.55 F |
| 52-33145 | 3/1977 | Japan | 219/10.55 F |
| 582997 | 6/1981 | Japan | 219/10.55 F |

*Primary Examiner*—Philip H. Leung

*Attorney, Agent, or Firm*—Cushman, Darby & Cushman

[57] ABSTRACT

A microwave range has an inner case defining a heating chamber therein. A rotatable tray made of a material permeable to electric waves is disposed in the heating chamber and adapted to receive thereon an object to be heated. A torque transmitting mechanism for transmitting torque to the tray is disposed between the tray and a bottom of the heating chamber. The mechanism has a roller holder having wave agitating sections for reflecting waves irradiated into the heating chamber to agitate the waves. A plurality of rollers are rotatably supported on the holder and roll on the bottom of the heating chamber. The tray is placed on the rollers. The roller holder is rotated by a motor.

14 Claims, 9 Drawing Figures

HIGH-FREQUENCY HEATING DEVICE HAVING ROTATABLE TRAY AND HIGH FREQUENCY WAVE AGITATOR

BACKGROUND OF THE INVENTION

The present invention relates to a high-frequency heating device, and more particularly to a high-frequency heating device having a rotatable tray on which an object to be heated is placed.

As a high-frequency heating device, such as a microwave range, a type in which a rotatable tray is disposed in the heating chamber so as to permit an object to be uniformly heated with high efficiency is well known. In this type of microwave range, the object is rotated together with the rotatable tray. Thus, the upper portion of the object can be heated almost uniformly by the high-frequency waves irradiated into the heating chamber.

However, it has been impossible to effectively agitate the high-frequency waves in the heating chamber by the rotation of the tray alone, so that the portions of the object which receive the high-frequency waves do not greatly change in position. For this reason, it is difficult for the high-frequency waves to reach the lower portion of the object, namely, the portion which is in contact with the rotatable tray and the portions close to that area. Thus, the object is still apt to be heated unevenly, making it difficult to satisfactorily cook the object.

SUMMARY OF THE INVENTION

The present invention has been contrived in consideration of the above circumstances, and the object of the invention is to provide a high-frequency heating device capable of heating an object with high efficiency and avoiding uneven heating of the object.

To achieve the above object, according to the present invention, there is provided a high-frequency heating device including: heating chamber; high frequency generating means for irradiating high-frequency waves into the heating chamber; a rotatable tray disposed in the heating chamber and adapted to support thereon an object to be heated, the rotatable tray being formed of a material permeable to electric waves; torque transmitting means, disposed between the rotatable tray and the bottom of the heating chamber, for transmitting torque to the rotatable tray, the transmitting means including a roller holder having a wave agitating section which reflects the waves passing through the rotatable tray so as to agitate the waves, and a plurality of rollers rotatably supported by the roller holder and rolling on the bottom of the heating chamber, and said rotatable tray being placed on the rollers; and driving means for rotating the roller holder.

According to the high-frequency heating device of the present invention, the rotatable tray and the roller holder are rotated at different speeds. Therefore, the high-frequency waves irradiated into the heating chamber are agitated by the rotation of the tray and the roller holder. At the same time, the wave agitating section of the roller holder reflects the waves which have passed through the rotatable tray, thereby agitating the waves. Thus, any portion of an object placed on the rotatable tray can be uniformly heated by the high-frequency waves.

BRIEF DESCRIPTION OF THE DRAWINGS

FIGS. 1 through 7 show a high-frequency heating device according to one embodiment of the present invention, in which:

FIG. 1 is a sectional view schematically showing the whole device, FIG. 2 is an enlarged sectional view showing the major portion of the device, FIG. 3 is a perspective view showing a roller holder, FIG. 4 is a perspective view showing the bottom of a rotatable tray, FIG. 5 is a perspective view showing an engaging plate and a rotating shaft, FIG. 6 is a plane view showing a changeover switch a cam, and FIG. 7 is a schematic view illustrating the operation of a roller;

DETAILED DESCRIPTION OF THE PREFERRED EMBODIMENTS

Figure 1:
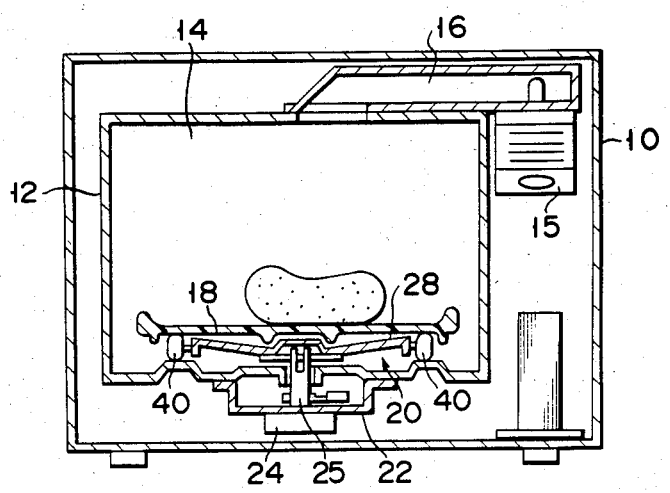

As shown in FIG. 1, the subject microwave range includes an outer case 10, and an inner case 12 disposed in the outer case 10. The inside of the inner case 12 defines a heating chamber 14. A magnetron 15 serving as high-frequency oscillating means is disposed between the outer and inner cases 10 and 12. It is connected to the heating chamber 14 by a wave guiding tube 16. The high-frequency waves generated by the magnetron 15 are guided by the wave guide tube 16 and irradiated into the heating chamber 14. In the inner case 12, there are provided a rotatable tray 18 on which an object to be heated is placed, and a torque transmitting mechanism 20 which is disposed between the rotatable tray 18 and the bottom surface of the heating chamber 14 to transmit torque to the rotatable tray 18.

Figure 2:
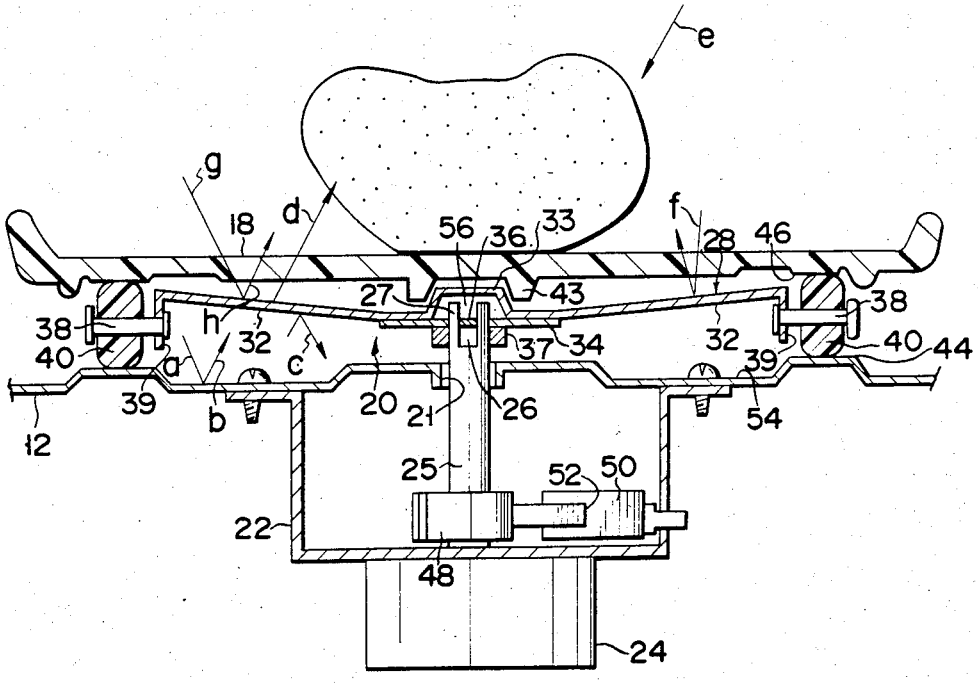
Figure 5:
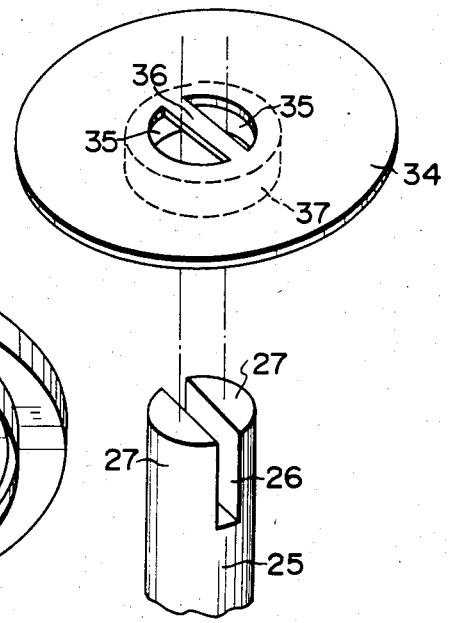

As shown in FIGS. 1 and 2, an opening 21 is provided in the bottom of the inner case 12, and a mounting plate 22 is secured to the lower surface of the bottom in such a manner as to cover the opening 21. A motor 24 serving as a driving mechanism is mounted on the mounting plate 22. A rotating shaft 25 of the motor 24 extends through the opening 21 into the heating chamber 14. As best shown in FIGS. 2 and 5, the upper end of the rotating shaft 25 is provided with an engaging groove 26 by which a pair of division pieces 27 are formed.

Figure 3:
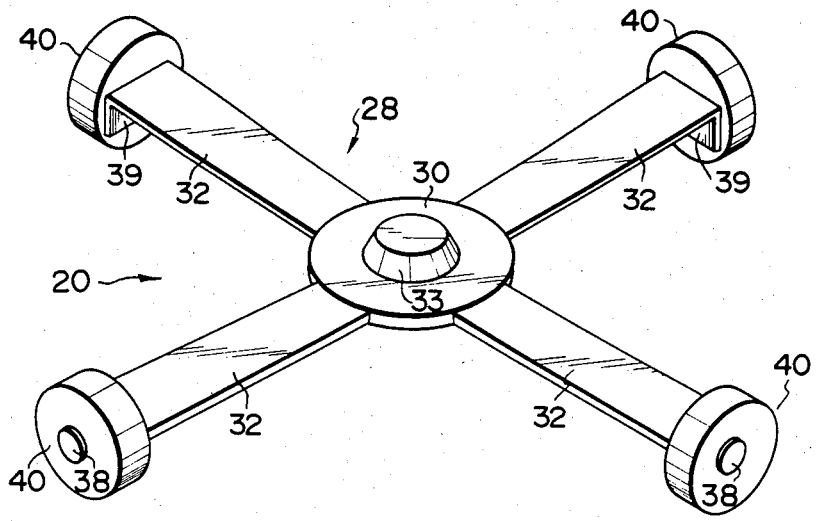

The torque transmitting mechanism 20 is provided with a roller holder 28 which is detachably attached to the rotating shaft 25 of the motor 24 and rotated by the motor 24. As shown in FIGS. 2 and 3, the roller holder 28 includes an engaging portion 30 which engages with both the rotating shaft 25 and rotatable tray 18, and four roller supporting arms 32 which radially extend from the engaging portion 30. The roller holder 28 is made of a metallic material capable of reflecting electric waves, and the roller supporting arms 32 of the roller holder 28 form a wave agitating section of the present invention.

A hollow boss 33 is formed in the center of the engaging portion 30. It extends upward and looks circular if viewed from above. An engaging plate 34 is secured to the engaging portion 30 in such a manner as to cover the open end of the boss 33. As best shown in FIG. 5, the engaging plate 34 is provided with a pair of insertion holes 35 located at the position facing the open end of the boss 33, and a substantially linear stopper 36 defined by the insertion holes 35. The insertion holes 35 conform in shape to the division pieces 27 at the upper end of the rotating shaft 25. By inserting the division pieces 27 into the insertion holes 35, the rotating shaft 25 of the motor 24 is detachably connected to the roller holder 28. An annular guide member 37 for guiding the insertion of the rotating shaft 25 into the insertion holes 35 is secured to the engaging plate 34.

Each roller supporting arm 32 is slanted upward so that the distance between each roller supporting arm 30 and the rotatable tray 18 gradually becomes smaller from the engaging portion 30 toward the end of each roller supporting arm 32. The end portion of each roller supporting arm 32 is bent downward to form a bent portion 39. This bent portion 39 rotatably supports a roller 40 through the use of a supporting shaft 38. The outer circumferential surface of each roller 40 is shaped in the form of an arc, and is in contact with the bottom of the heating chamber 14. When the roller holder 28 is rotated, the rollers 40 roll on the bottom of the heating chamber 14.

Figure 4:
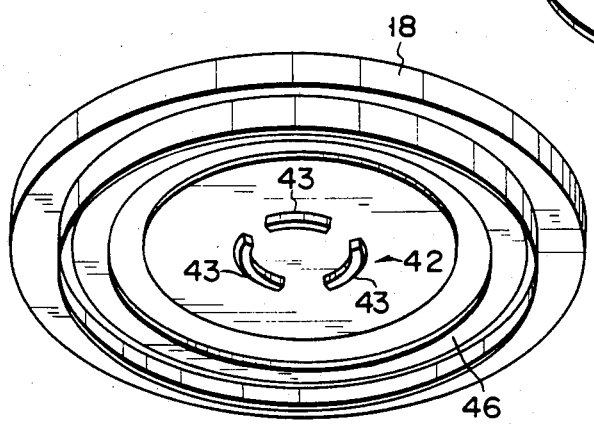

The rotatable tray 18 is formed of a material permeable to waves, such as heatproof glass, plastics, etc. It is placed on the rollers 40. As shown in FIGS. 2 and 4, the rotatable tray 18 is provided, on the lower surface, with a guide portion 42 for positioning the rotatable tray 18 in cooperation with the circular boss 33 of the roller holder 28. The guide portion 42 is formed by dividing an annular projection which is coaxial with the rotatable tray 18 into a plurality of pieces 43 (e.g., four pieces). The inner surface of each arcuate projection 43 includes a sliding surface which slidably contacts the outer surface of the boss 33. The sliding surface of each arcuate projection 43 is smooth, so that a smooth sliding movement is ensured.

When the roller holder 28 is rotated by the motor 24, each roller 40 rolls while contacting the bottom of the heating chamber 14 and the lower surface of the rotatable tray 18, thereby transmitting the torque of the motor 24 to the rotatable tray 18. Thus, the rotatable tray 18 is rotated. That portion of the bottom of the heating chamber 14 which contacts the rollers 40 is formed to be an annular projection 44, and similarly that portion of the lower surface of the rotatable tray 18 which contacts the rollers 40 is formed to be an annular projection 46. The projection 46 of the rotatable tray 18 has a roughened surface which causes great frictional force, so that torque can be reliably transmitted from the rollers 40 to the rotatable tray 18. The distance between the upper surface of the rotatable tray 18 and the bottom surface of the heating chamber 14 is about 30.5 mm, which approximately corresponds to one fourth of the frequency (2450 MHz or thereabout) of the waves generated by the magnetron 15.

Figure 6:
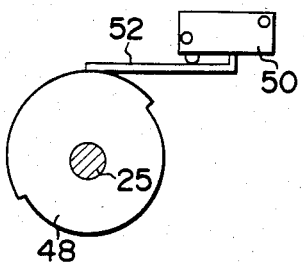

As shown in FIGS. 2 and 6, a cam 48 is fixed to the rotating shaft 25 of the motor 24 in the inside of the mounting plate 22. The cam surface of the cam 48 is in contact with an operating element 52 of a microswitch 50 secured to the mounting plate 22.

A description will now be given of the operation of the microwave range having the above structure.

Figure 7:
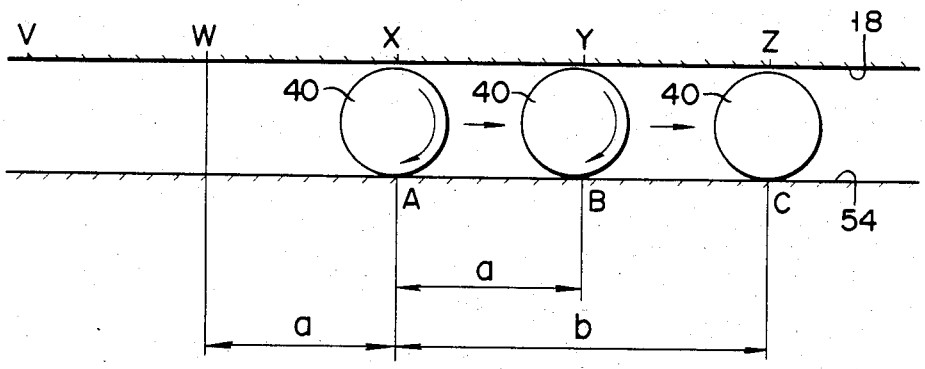

When the motor 24 is driven, the rotating shaft 25 is rotated at a given rotational frequency (e.g., 3 rpm), and this rotation is transmitted to the roller holder 28 through the division pieces 27. If the roller holder 28 is rotated, the rollers 40 roll on the bottom of the heating chamber 14. The rotation of the rollers 40 is transmitted to the rotatable tray 18 which is in contact with the rollers 40, so that the tray 18 is rotated in the same direction as the roller holder 28 and at a rotational frequency (i.e., 6 rpm) twice as high as that of the roller holder 28. The rotation of the tray 18 will be described in more detail with reference to FIG. 7. Suppose that roller 40 located at position A makes a half turn and comes to position B (which is away from position A by distance a). In accordance with this movement of roller 40, the rotatable tray 18 is moved from position X to W relative to roller 40, i.e., the tray 18 is moved to position Y relative to the bottom 54 of the heating chamber 14. Thus, when roller 40 makes a half turn, the roller holder 28 moves by distance a relative to the bottom 54 of the heating chamber 14 and the tray 18 moves from position W to position Y, i.e., by distance ($a \times 2$). Therefore, when roller 40 makes one turn, it moves from position A to position C, i.e., by distance b, and the tray 18 is moved from position V to position Z. In this way, the tray 18 is rotated in the same direction as the roller holder 28 and at a rotational frequency twice that of the roller holder 28.

Since the cam 48 is fixed to the rotating shaft 25, it is rotated integrally with the rotating shaft 25 (at 3 rpm). At this time, the microswitch 50 is turned on and off by the cam surface. The magnetron 15 is adapted to produce a small output while the microswitch 50 is off. If the time, in which the output of the magnetron 15 is kept small, is so set as to account for 50% of the whole time of one cycle, then the time, in which the microswitch 50 is on, is set to be 10 seconds, and the time, in which the microswitch 50 is off, is set to be 10 seconds (the time of one cycle: 20 seconds).

As shown in FIG. 2, the high-frequency waves irradiated from the wave guide tube 16 into the heating chamber 14 propagate in various directions. Some waves advance directly to the to-be-heated object and are absorbed by it. Some waves (indicated by arrow g) pass through the rotatable tray 18, are reflected by the supporting arms 32 of the roller holder 28 (as indicated by arrow f), and are then absorbed by the object. And, some waves pass through the rotatable tray 18, pass between the supporting arms 32, and are reflected by the bottom of the heating chamber 14 (as indicated by arrow b). Part of the waves reflected by the bottom of the heating chamber 14 strike against the supporting arms 32 and are reflected (as indicated by arrow c), and part of them pass between the adjacent supporting arms 32, pass through the rotatable tray 18, and are absorbed by the object (as indicated by arrow d). In this manner, the waves irradiated into the heating chamber 14 are agitated, being reflected in various directions by the supporting arms 32 of the roller holder 28. Thus, as long as the roller holder 28 is rotating, the portions of the object which absorb the waves are constantly changing in position, with the result that any portion of the object absorbs the waves uniformly and is heated. Therefore, the object is prevented from being unevenly heated and the waves irradiated into the heating chamber 14 are uniformly absorbed by the object, thus improving the heating efficiency.

As noted above, the distance between the upper surface of the rotatable tray 18 and the bottom surface of the heating chamber 14 is set to be 30.5 mm so that it may approximately correspond to one fourth of the frequency (2450 MHz) of the waves generated by the magnetron 15. Due to this, the waves advancing directly toward the bottom of the heating chamber 14 (such as the wave indicated by arrow a) and the waves reflected by the bottom of the heating chamber 14 (as indicated by arrow b) interact with each other in the neighbourhood of the upper surface of the rotatable tray 18, causing an even electric field. Thus, they are uniformly absorbed by the object. Further, as noted above, each supporting arm 32 of the roller holder 28 extends slightly upward from the engaging portion 30. Because of this structure, the waves striking against each supporting arm 32 (such as the wave indicated by arrow g) are reflected toward the central portion of the rotatable tray 18. As a result, they are collected in the neighbourhood of the central portion of the rotatable tray 18, causing an electric field stronger than those of the other regions. Since the object is placed in this strong electric field, it can absorb waves easily, thereby further improving the heating efficiency. Still further, the roller holder 28 (which reflects waves) and the rotatable tray 18 (which is permeable to waves) are rotated at different speeds, the waves in the heating chamber 18 can be effectively diffused or agitated.

Although the rotation of the rotatable tray 18 is achieved by the torque transmitted through the rollers 40, the center of the rotation of the tray 18 is determined by the engagement between the boss 33 of the engaging portion 30 and the guide portion 42. Thus, the tray 18 does not slip relative to the roller holder 28, and the rollers 40 are always in contact with the peripheral portion of the tray 18. For this reason, the tray 18 can be reliably rotated with sufficient torque by the rollers 40. Further, since the engaging portion 30 and the guide portion 42 are disposed on the lower side of the tray 18, small bits of food or the like will rarely attach to the engaging and guide portions 30 and 42. Therefore, the tray 18 can be rotated smoothly. In addition, the guide portion 42 is formed by a plurality of arcuate projections 43. Thus, even if an object is heated to such an extent that the temperature of the tray 18 increases too high or if much frictional heat is caused due to the difference in the rotational speed between the engaging and guide portions 30 and 42, heat is radiated through the gap between the adjacent projections 43. For this reason, the temperature of the engaging and guide portions 30 and 42 do not become too high. Even if small bits of food or the like should get attached to the guide portion 42, they are expelled from the guide portion 42 through the gap between the adjacent projections 43 due to the rotation of the tray 18 and roller holder 28.

According to the embodiment described above, that portion of the bottom of the heating chamber 14 which contacts with the rollers 40 is formed by the annular projection 44, and the corresponding portion of the lower surface of the tray 18 is also formed by the annular projection 46. Thus, even if small bits of food or the like collect in those portions, they can be easily wiped away. Thus, the cleaning operation can be performed with ease, and a normal rotation of the roller holder 28 and tray 18 can be ensured. Further, since the weight of an object placed on the tray 18 tends to be applied to the whole area of the bottom of the heating chamber 14, the bottom of the heating chamber 14 is prevented from being deformed by the weight of the object. Thus, it is possible to cook the object with a stable electric field. Still further, since the outer circumferential surface of each roller 40 is shaped in the form of an arc, each roller 40 contacts the projections 44 and 46 with a very narrow contact area, thereby reducing the possibility that each roller 40 will contact small bits of food or the like. Thus, vibration of the tray 18 and unusual noises can be avoided. It is also to be noted that the roller holder 28 is driven by the motor 24 and the torque of the roller holder 28 is transmitted to the tray 18 through the rollers 40 so as to rotate the tray 18. With this structure, even if some bits of food or the like get attached to the bottom of the heating chamber, each roller 40 rolls over the bits of food. Thus, the roller holder 28 and the tray 18 can be rotated smoothly even if the bottom of the heating chamber is not cleaned frequently.

In the above-mentioned embodiment, the opening of the boss 33 of the roller holder 28 is closed by the engaging plate 32, and a choke chamber 56 for attenuating waves is defined by the boss and the engaging plate. By this choke chamber 56, the rotating shaft 25 and the roller holder 28 are prevented from being unusually heated, and sparks between the two can be avoided. In addition, the engaging plate 34 is provided with the annular guide member 37 for facilitating the insertion of the rotating shaft 25. Therefore, when the roller holder 28 is coupled to the rotating shaft 25, the rotating shaft 25 can be easily inserted into the insertion holes 35 while being guided by the guide member 27. In this way, the operation of coupling the roller holder to the rotating shaft is easy. The guide member 37 is also effective in preventing the tray 18 from becoming unsteady relative to the rotating shaft 25.

The cam 48 secured to the rotating shaft 25 of the motor 24 is rotated at a speed (3 rpm) which is one half of the rotational frequency of the tray 18, and, therefore, the microswitch 50 is switched on or off at intervals of 10 seconds. In contrast, in a microwave range in which the rotatable tray is directly driven by a motor, the rotating shaft is rotated at the same speed as the rotatable and tray i.e., it is rotated at a speed (6 rpm) twice as high as the speed of the rotating shaft of the present invention. Thus, if a cam is directly coupled to the rotating shaft, the microswitch is switched on or off at intervals of 5 seconds. If the amount of microswitch is switched on or off so frequently, the time when high-frequency waves are irradiated into the heating chamber is very short. Thus, it is difficult to appropriately thaw frozen food or to satisfactorily cook the food. In addition, since the microswitch is switched on and off twice the number of times, it will not be able to withstand long use. To avoid these problems, the above conventional type of microwave range must be provided with a speed-decreasing mechanism, such as a gear. The provision of the speed-decreasing mechanism will increase the manufacturing cost of the microwave-range. The device of the present invention is free from the problems without employing any speed-decreasing gear.

The present invention is not limited to the above embodiment. It may be modified in various manners without departing from the scope of the invention.

Figure 8:
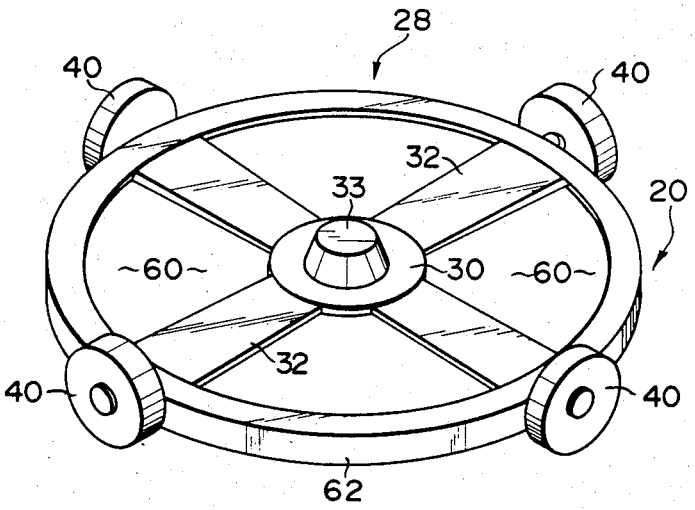
FIG. 8 is a perspective view showing a modification of the roller holder.

In the above-mentioned embodiment, the roller holder 28 is substantially cross-shaped. However, it may be formed in the manner shown in FIG. 8. According to this modification, the roller holder 28 is prepared by providing a plurality of fan-shaped openings 60 in a discoid plate. The central portion of the discoid plate forms the engaging portion, and a plurality of wave agitating arms 32 are formed by providing the openings 60. A flange 62 is formed in the cirfumferential edge of the discoid plate, and a plurality of rollers 40 (e.g., four rollers) are rotatably secured to the flange 62. Each roller 40 is spaced apart from the adjacent ones by the same interval. As in the above-mentioned embodiment, each wave agitating arm 32 is slightly slanted upward. The shape and number of the openings 60 are not limited to the above. They may also be determined in accordance with necessity.

Figure 9:
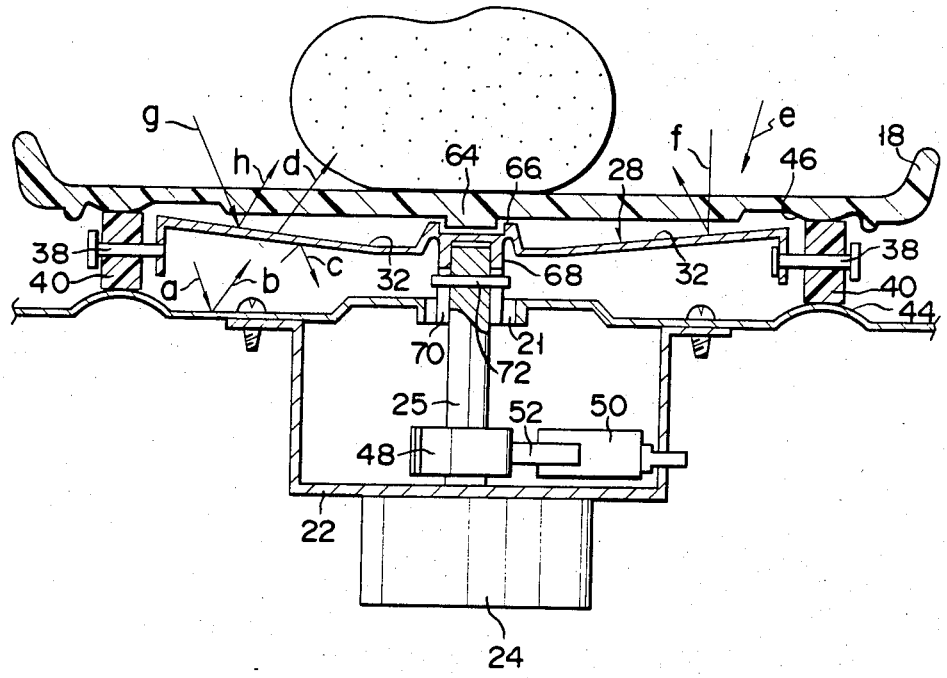
FIG. 9 is a sectional view corresponding to that of FIG. 2 and illustrating another embodiment of the present invention.

In the above-mentioned embodiment, the positioning of the rotatable tray is performed by matching the convex portion 33 of the roller holder to the concave portion 34 of the rotatable tray which is conformable in shape to the convex portion 33. However, as shown in FIG. 9, a convex portion 64 and a concave portion 66 which is conformable in shape to the convex portion 64, may be provided to the rotatable tray 18 and roller holder 28, respectively. Further, the outer circumferential surface of each roller 40 need not be shaped in the form of an arc. It may be shaped to be flat. In this case, the contact surfaces of the heating chamber bottom and rotatable tray are shaped in the form of an arc. Even with this structure, the effects are the same as the above-mentioned embodiment. Still further, the roller holder 28 and the rotating shaft 25 of the motor 24 may be coupled to each other by providing an engaging cylinder 68. As shown in FIG. 9, this engaging cylinder 68 extends downward from the engaging portion of the roller holder and is provided with engaging grooves 70. An engaging pin 72 is embedded in the rotating shaft, and this rotating shaft is inserted into the engaging cylinder.

What is claimed is:

1. A high-frequency heating device comprising:

a heating chamber;

high-frequency oscillating means for irradiating high-frequency waves into the heating chamber;

a rotatable tray disposed in the heating chamber and adapted to receive thereon an object to be heated, said rotatable tray being made of a material permeable to electric waves and having a guide portion formed at a central portion of its lower surface;

torque transmitting means, disposed between the rotatable tray and the bottom of the heating chamber, for transmitting torque to the rotatable tray, said torque transmitting means including a roller holder having an engaging portion and a plurality of roller supporting arms which extend radially from the engaging portion and are slanted upward toward the rotatable tray to reflect waves passed through the rotatable tray toward the object on the rotatable tray, and a plurality of rollers rotatably supported on the extended end of the corresponding roller supporting arms and adapted to roll on the bottom of the heating chamber, said rotatable tray being placed on the rollers; and driving means for rotating the roller holder, said engaging portion of the roller holder detachably coupled to the driving means to thereby facilitate cleaning of underlying surfaces, and being engaged with the guide portion of the rotatable tray to position the rotatable tray relative to the roller holder.

2. A high-frequency heating device according to claim 1, wherein said engaging portion includes a hollow projection extending toward the rotatable tray and adapted to engage with the guide portion, and said guide portion is formed by dividing an annular projection extending from the lower surface of the rotatable tray into a plurality of pieces.

3. A high-frequency heating device according to claim 2, wherein said driving means includes a motor disposed outside the heating chamber, and said motor has a rotating shaft extending into the heating chamber through the bottom of the heating chamber and engaging with the engaging portion of the roller holder.

4. A high-frequency heating device according to claim 3, wherein said engaging portion includes engaging plate for covering an opening of the hollow projection, and a pair of insertion holes formed in the engaging plate, and said rotating shaft has an extended end divided into a pair of pieces and inserted into the insertion holes.

5. A high-frequency heating device according to claim 4, wherein said engaging portion includes an annular guide member attached to said engaging plate and adapted to guide the insertion of the rotating shaft.

6. A high-frequency heating device according to claim 4, wherein said hollow projection and engaging plate define a choke chamber for attenuating waves.

7. A high-frequency heating device according to claim 1, wherein the distance between the upper surface of the rotatable tray and the bottom of the heating chamber is set such that it corresponds to one fourth of the frequency of the waves irradiated from the high-frequency generating means into the heating chamber.

8. A high-frequency heating device according to claim 1, wherein each of said rollers has an outer circumferential surface shaped in the form of an arc.

9. A high-frequency heating device according to claim 1, wherein that portion of the bottom of the heating chamber which contacts the rollers forms an annular projection protruding toward the rotatable tray.

10. A high-frequency heating device according to claim 9, wherein that portion of the lower surface of the rotatable tray which contacts the rollers forms an annular projection protruding toward the bottom of the heating chamber.

11. A high-frequency heating device according to claim 1, wherein said roller holder includes a discoid body formed of wave reflecting material, an engaging portion formed in the central portion of the body and detachably coupled to the driving means, a plurality of openings formed in the body and defining a wave agitating section, and a flange formed around the periphery of the body, and said rollers are rotatably supported on the flange and spaced apart from the adjacent ones at equal intervals.

12. A high-frequency heating device comprising:

a heating chamber;

high-frequency oscillating means for irradiating high-frequency waves into the heating chamber;

a rotatable tray disposed in the heating chamber and adapted to receive thereon an object to be heated, said rotatable tray being made of a material permeable to electric waves;

torque transmitting means, disposed between the rotatable tray and the bottom of the heating chamber, for transmitting torque to the rotatable tray, said torque transmitting means including a roller holder having an engaging portion and wave agitating means for agitating the waves by reflecting waves which have passed through the rotatable tray, and a plurality of rollers rotatably supported by the roller holder and adapted to roll on the bottom of the heating chamber, said rotatable tray being placed on the rollers; and driving means for rotating the roller holder, said driving means having a motor, the rotating shaft of which extends into the heating chamber and to which said engaging portion of the roller holder is detachably coupled to thereby facilitate cleaning of underlying surfaces, and a guide member which guides the rotating shaft and the roller holder together for coupling.

13. A high-frequency heating device according to claim 12, wherein said engaging portion has a pair of insertion holes, and said rotating shaft has an end divided into two pieces inserted in said insertion holes.

14. A high-frequency heating device according claim 13, wherein said engaging portion includes an annular guide member for guiding the end of said rotating shaft into said insertion holes.

* * * * *